US009964087B2

(12) United States Patent
Ruffino

(10) Patent No.: US 9,964,087 B2
(45) Date of Patent: May 8, 2018

(54) METHOD FOR PRODUCING A NOZZLE FOR INJECTORS OF INTERNAL COMBUSTION ENGINES

(71) Applicant: O.M.T. Officine Meccaniche Torino S.p.A., Cascine Vica-Rivoli (Turin) (IT)

(72) Inventor: Giorgio Ruffino, Turin (IT)

(73) Assignee: O.M.T. OFFICINE MECCANICHE TORINO S.P.A., Cascine Vica-Rivoli Turin (IT)

( * ) Notice: Subject to any disclaimer, the term of this patent is extended or adjusted under 35 U.S.C. 154(b) by 279 days.

(21) Appl. No.: 15/080,346

(22) Filed: Mar. 24, 2016

(65) Prior Publication Data

US 2016/0290301 A1 Oct. 6, 2016

(30) Foreign Application Priority Data

Mar. 31, 2015 (IT) ..... UB2015A000259

(51) Int. Cl.
*F02M 61/18* (2006.01)
*C23C 24/08* (2006.01)
(Continued)

(52) U.S. Cl.
CPC ..... *F02M 61/168* (2013.01); *C23C 24/06* (2013.01); *C23C 24/08* (2013.01); *F02M 61/166* (2013.01);
(Continued)

(58) Field of Classification Search
CPC .... F02M 61/166; F02M 61/168; F02M 61/18; F02M 2200/02; F02M 2200/04;
(Continued)

(56) References Cited

U.S. PATENT DOCUMENTS

2016/0361766 A1* 12/2016 Berglund ..... B22F 3/15

FOREIGN PATENT DOCUMENTS

EP 2679323 A1 1/2014
KR 2007-0108495 A 11/2007
(Continued)

OTHER PUBLICATIONS

English translation of Chinese Office Action dated Dec. 4, 2017, for Chinese Patent Application No. 201610191040.8.
(Continued)

*Primary Examiner* — Matthew P Travers
(74) *Attorney, Agent, or Firm* — Patterson + Sheridan, LLP

(57) ABSTRACT

A method for producing nozzles for injectors of internal combustion engines comprising machining nozzle blanks, each having a cylindrical surface with first and second ends, a flat reference surface at the first end and a nozzle tip projecting from the second end, applying a protective disc onto each flat reference surface, providing a containment tube with a closed first end, sequentially inserting the nozzle blanks into the containment tube and completely filling a space delimited from an outer surface of the nozzle tip of the respective nozzle blank to an inner wall of the containment tube after each insertion, compacting the metal powder, evacuating a second end of the containment tube, hot isostatic pressing the containment tube, cutting the containment tube along cutting sections aligned with the protective discs to form separate sections, and machining the sections to form a metallic coating on each nozzle tip.

9 Claims, 8 Drawing Sheets

(51) Int. Cl.
*B22F 3/15* (2006.01)
*F02M 61/16* (2006.01)
*C23C 24/06* (2006.01)

(52) U.S. Cl.
CPC ..... *F02M 61/18* (2013.01); *B22F 3/15* (2013.01); *B22F 2998/10* (2013.01); *B22F 2999/00* (2013.01); *F02M 2200/05* (2013.01); *F02M 2200/8053* (2013.01); *F02M 2200/8069* (2013.01); *F02M 2200/9038* (2013.01)

(58) Field of Classification Search
CPC ..... F02M 2200/05; F02M 2200/8053; F02M 2200/8069; F02M 2200/9038; B22F 3/004; B22F 3/093; B22F 3/1208; B22F 3/15; B22F 3/16; B22F 3/162; B22F 2003/247; B22F 5/008; B22F 7/04–7/2007; B22F 2201/20; B22F 2301/15; B22F 2998/10; B23P 2700/50; C23C 24/08; Y10T 29/49432; Y10T 29/49433
See application file for complete search history.

(56) References Cited

FOREIGN PATENT DOCUMENTS

| | | | |
|---|---|---|---|
| WO | 2004030850 | A1 | 4/2004 |
| WO | 2011050814 | A1 | 5/2011 |

OTHER PUBLICATIONS

Italian Search Report and Written Opinion dated Nov. 19, 2015 for Application No. 102015000010383.

* cited by examiner

METHOD FOR PRODUCING A NOZZLE FOR INJECTORS OF INTERNAL COMBUSTION ENGINES

CROSS-REFERENCE TO RELATED APPLICATIONS

This application claims benefit of Italian patent application number 102015000010383, filed Mar. 31, 2015, which is herein incorporated by reference.

BACKGROUND OF THE INVENTION

Field of the Invention

The present invention relates to a method for producing a nozzle for injectors of internal combustion engines.

More precisely, the invention relates to a method for producing a nozzle for injectors of internal combustion engines having a nozzle tip with an outer surface coated with a layer of material that is highly resistant to corrosion.

Description of Prior Art

EP-A-2679323 describes a method for producing a nozzle provided with a metal coating, comprising the steps of:

providing a hollow metal body, which comprises a nozzle tip and a side wall that surrounds the nozzle tip, forming a hollow space;

filling the hollow space with a powdered metal coating material;

inserting an array of metal bodies into a tube;

closing the tube and evacuating the air from within the tube; and subjecting the tube to hot isostatic pressing (HIP) so that the powdered coating material forms a solid coating bonded to the nozzle tip.

Subsequently, the body with the nozzle tip covered by the coating material is subjected to a machining, during which the side wall and a portion of the coating material are removed, so as to leave a layer of coating around the nozzle tip.

This method requires the production of a hollow body with a central core and an outer wall that surrounds the central core so as to form an inner space, which is filled with the powdered coating material. The production of a hollow body of this type is complex and expensive. The method described in EP-A-2679323 also requires a precise coupling between the tube and the hollow bodies to ensure that the coated body is symmetrical about its central axis.

SUMMARY OF THE INVENTION

The present invention has the object of providing a method for producing a nozzle for internal combustion engines provided with a coating of corrosion-resistant material, which is simpler and cheaper than the methods according to the prior art, and which provides a greater uniformity of the coating thickness.

According to the present invention, this object is achieved by a method having the characteristics forming the subject of claim 1.

The claims form an integral part of the disclosure provided in relation to the invention.

BRIEF DESCRIPTION OF THE DRAWINGS

The present invention will now be described in detail with reference to the attached drawings, given purely by way of non-limiting example, wherein.

DETAILED DESCRIPTION

FIGS. 1 to 18 schematically illustrate the steps of a method according to the present invention for producing a nozzle for injectors of internal combustion engines provided with a coating of corrosion-resistant material.

Figure 1:
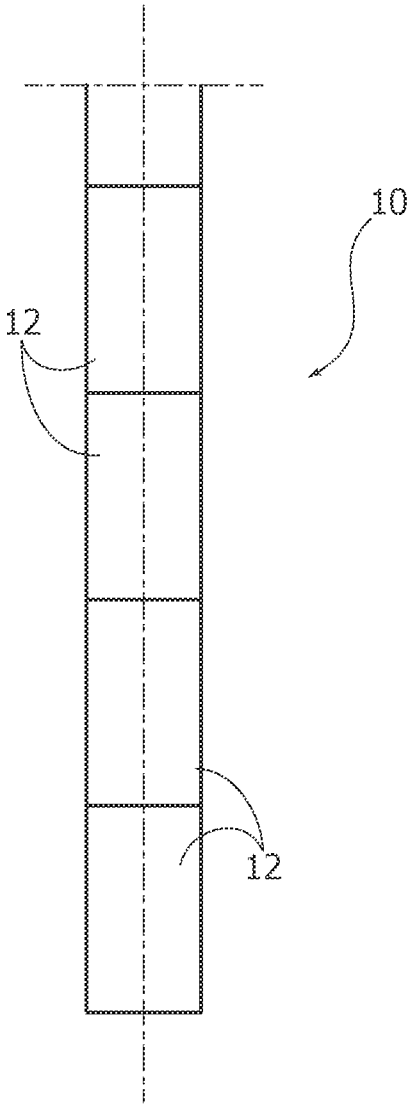
FIGS. 1 to 18 are schematic views illustrating the different steps of the method according to the present invention.

With reference to FIG. 1, the first step of the method involves cutting a cylindrical metal bar 10, typically of steel, into a plurality of cylindrical sections 12.

Figure 2:
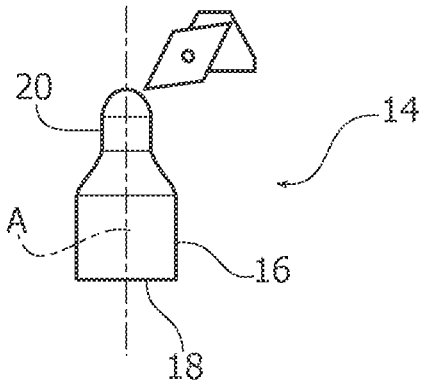

As shown in FIG. 2, the cylindrical sections 10 are machined, typically by means of turning, so as to form a plurality of nozzle blanks 14, each of which has a cylindrical surface 16, a flat reference surface 18 at a first end of the cylindrical surface 16 and a nozzle tip 20 that projects from a second end of the cylindrical surface 16 opposite to the flat reference surface 18. The surface 18 is used as a reference surface for the turning operations, so that the nozzle tip 20 has an axis of longitudinal symmetry A perfectly orthogonal to the flat reference surface 18.

It is also possible to obtain the nozzle blanks 14 directly on the cylindrical bar 10 by means of turning and carrying out the cutting of the bar on the turning machine. The flat reference surface 18 is formed with a transverse cut and is perfectly orthogonal to the axis of longitudinal symmetry A of the nozzle tip 20.

Figure 3:
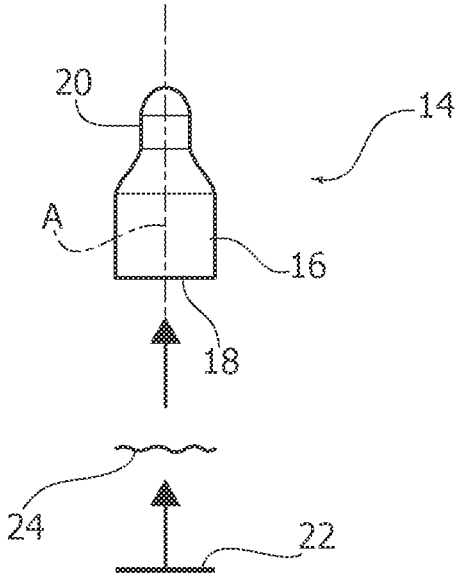

With reference to FIG. 3, on the flat reference surface 18 of each nozzle blank 14, a protective disc 22 of non-metallic material, with a high melting temperature, is applied. The protective disk 22 can be made, for example, of boron or similar non-metallic materials. The protective disc 22 has the same diameter of the flat reference surface 18. The protective disc 22 is fixed to the flat reference surface 18, preferably by means of a layer of adhesive 24.

Figure 4:
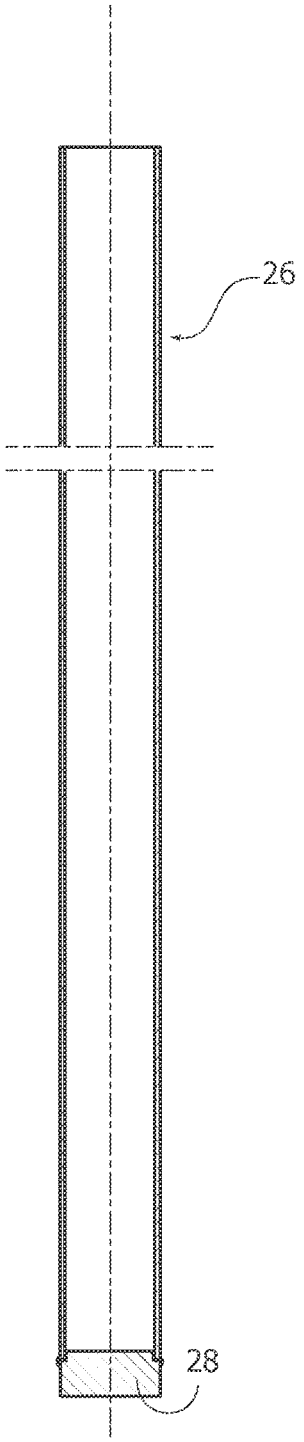

With reference to FIG. 4, the method according to the present invention includes the provision of a metallic containment tube 26, elongated in the direction of its longitudinal axis. A first end of the containment tube 26 is closed by a metal cap 28 fixed to the containment tube 26 by welding. The opposite end of the containment tube 26 remains open.

Figure 5:
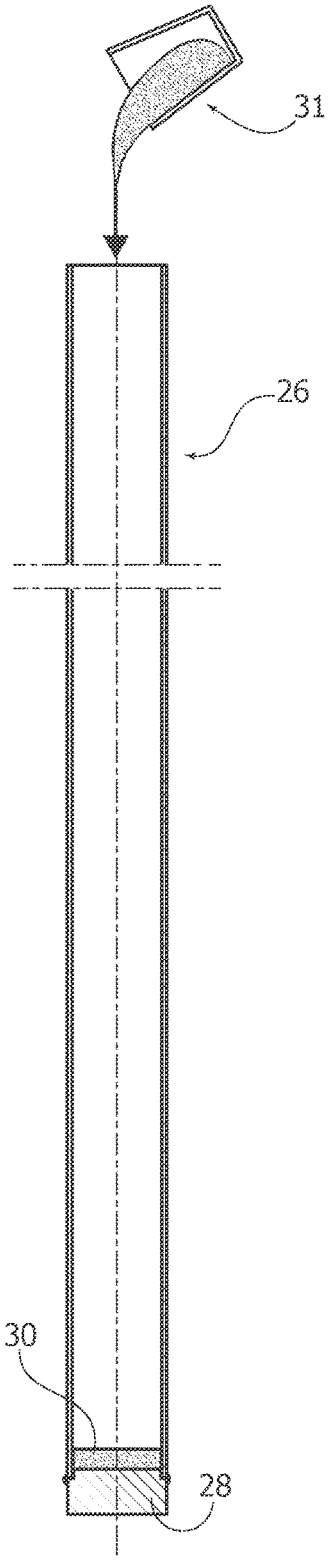

With reference to FIG. 5, the containment tube 26 is oriented in the vertical direction with the closed end downwards. On the bottom of the containment tube 26, a layer 30 of metal powder is deposited. The layer of powder 30 is poured through the open end of the containment tube 26 by means of a controlled dosage device, schematically indicated by 31.

Figure 6:
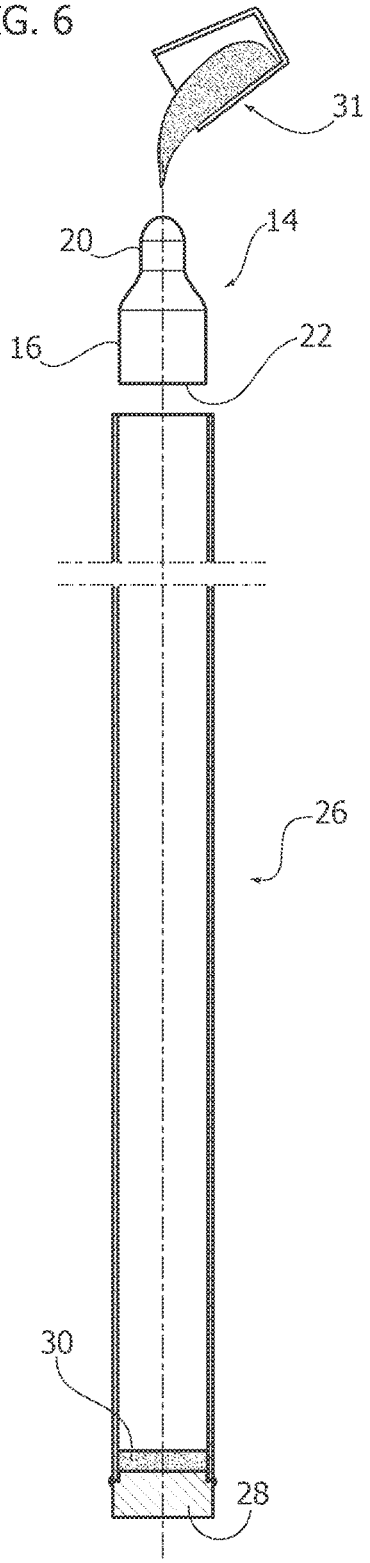

Then, as shown in FIG. 6, a first nozzle blank 14 is inserted inside the containment tube 26. The cylindrical surface 16 of the nozzle blank 14 is in contact with the inner cylindrical surface of the containment tube 26, but a precise coupling between these surfaces is not required. The protective disc 22 of the first nozzle blank 14 rests on the layer of powder 30 applied to the bottom of containment tube 26.

After inserting the first nozzle blank 14 onto the bottom of the containment tube 26, a controlled quantity of metal powder 32 is poured inside the containment tube 26. The metal powder is formed of sinterable material with high resistance to corrosion, for example, from a nickel-based alloy. The amount of powder 32 is measured so as to fill the free space between the inner wall of the containment tube 26 and the outer surface of the nozzle tip 20, and also to form a layer of powder above the nozzle tip 20.

Figure 7:
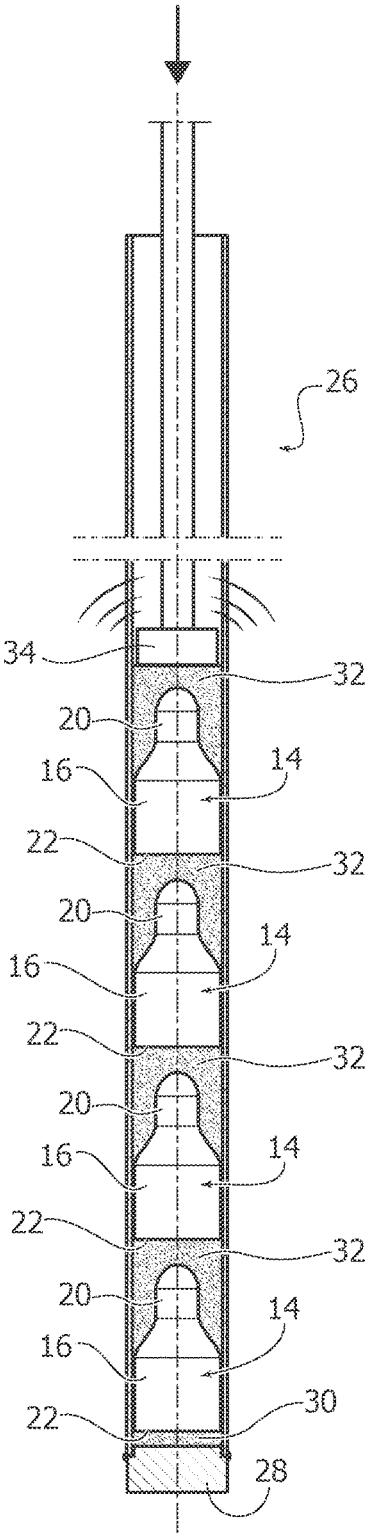

Then, as shown in FIG. 7, subsequent nozzle blanks 14 are inserted into the containment tube 26, and after inserting each nozzle blank 14, a controlled amount of powder 32 is poured over the just-inserted nozzle blank 14.

In this way, an array of nozzle blanks 14 is formed, aligned within the containment tube 26, with the individual nozzle blanks 14 spaced apart by layers of metal powder 32. Each nozzle blank 14 rests on the layer of powder 32 below, with the respective protective disc 22 which prevents contact between the flat reference surface 18 and the metal powder 32.

After having inserted a group of four to five nozzle blanks 14 into the containment tube 26, a compaction of the powder 32 is carried out by means of a presser 34, preferably with a simultaneous vibration of the containment tube 26.

Figure 8:
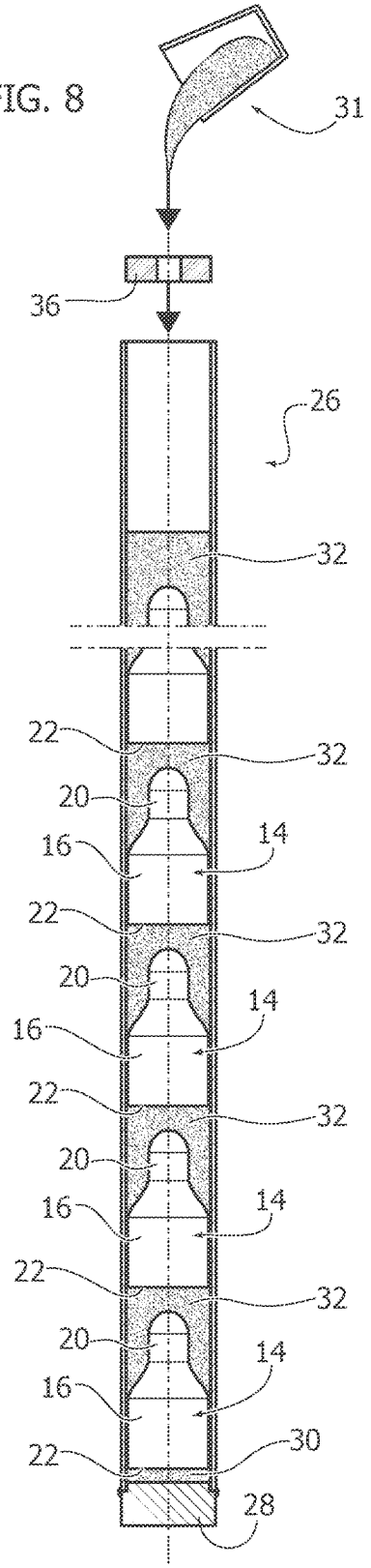

With reference to FIG. 8, after having arranged the prescribed number of nozzle blanks 14 within the containment tube 26, a perforated closing disc 36 is arranged above the last layer of powder 32.

Figure 9:
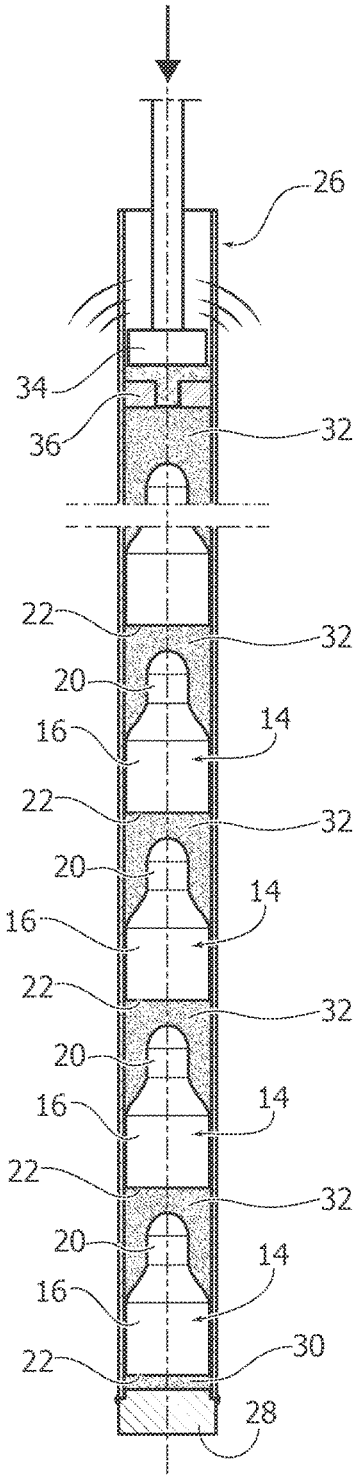

With reference to FIG. 9, after having positioned the perforated disk 36 above the highest layer of powder 32, an additional measured quantity of powder is poured over the perforated disc 36, and a further compacting step is carried out by means of the presser 34. A better compaction of the powder 32 is obtained by applying vibrations to the containment tube 26 simultaneously to the compression, by means of the presser 34. A simple and effective method for vibrating the containment tube 26 during the compacting step consists of hammering on the outer surface of the containment tube 26.

Figure 10:
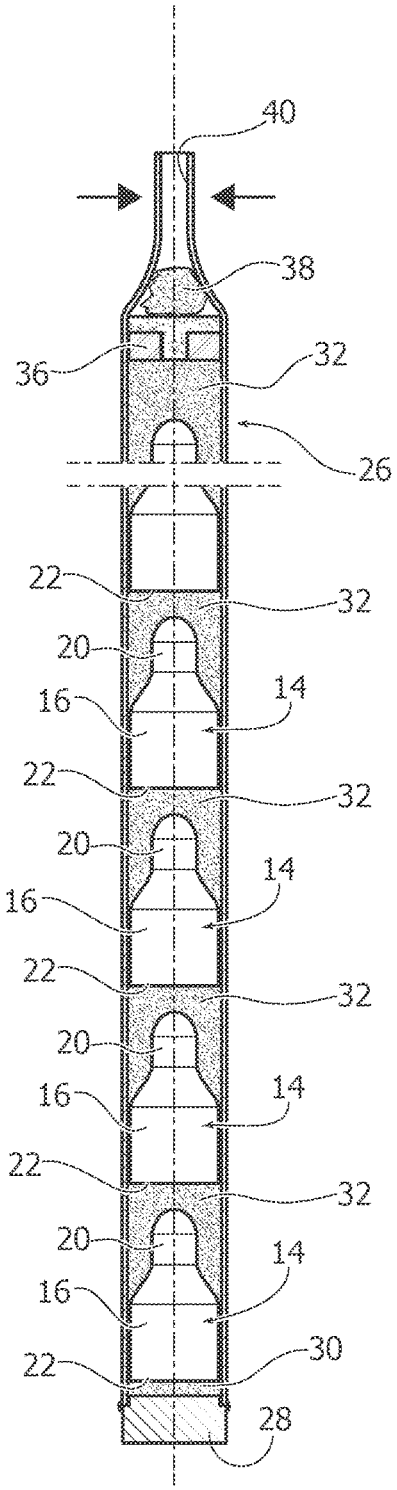

With reference to FIG. 10, after the compacting step, a cotton filter 38 is arranged within the upper end of the containment tube 26, and the upper end of the containment tube 26 is compressed so as to mechanically lock the perforated ring 36 and the cotton filter 38. The deformation of the end of the tube does not completely close the upper end of the containment tube 26, but leaves a channel 40 with a smaller diameter than the original diameter of the containment tube 26.

Figure 11:
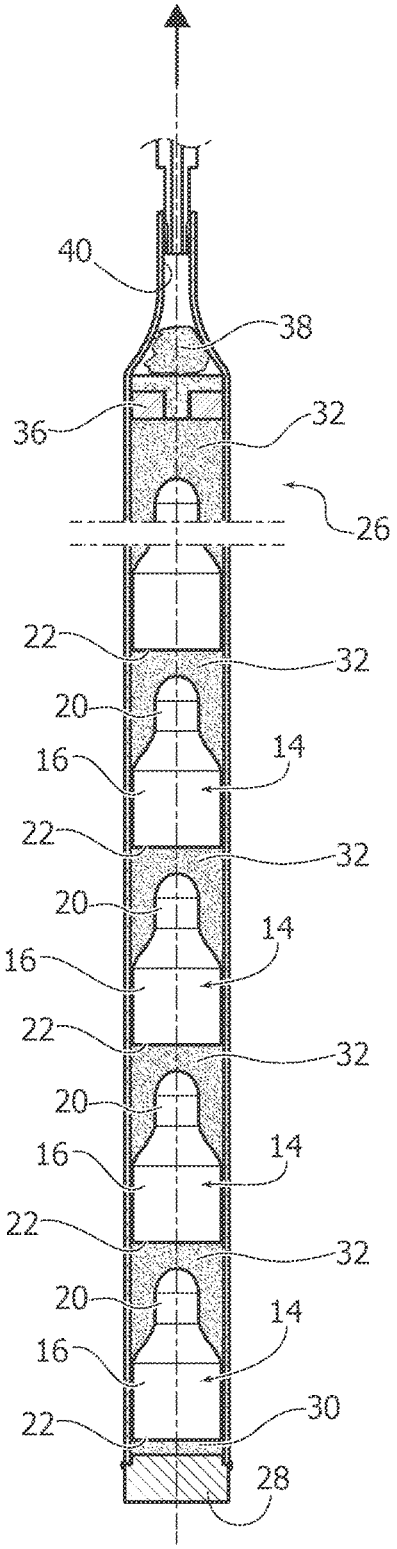

Subsequently, the channel 40 of the containment tube 26 is connected to a suction source as shown in FIG. 11. The cotton filter 38 avoids the powder 32 being aspirated. In this step, the air inside the containment tube 26 is removed.

Figure 12:
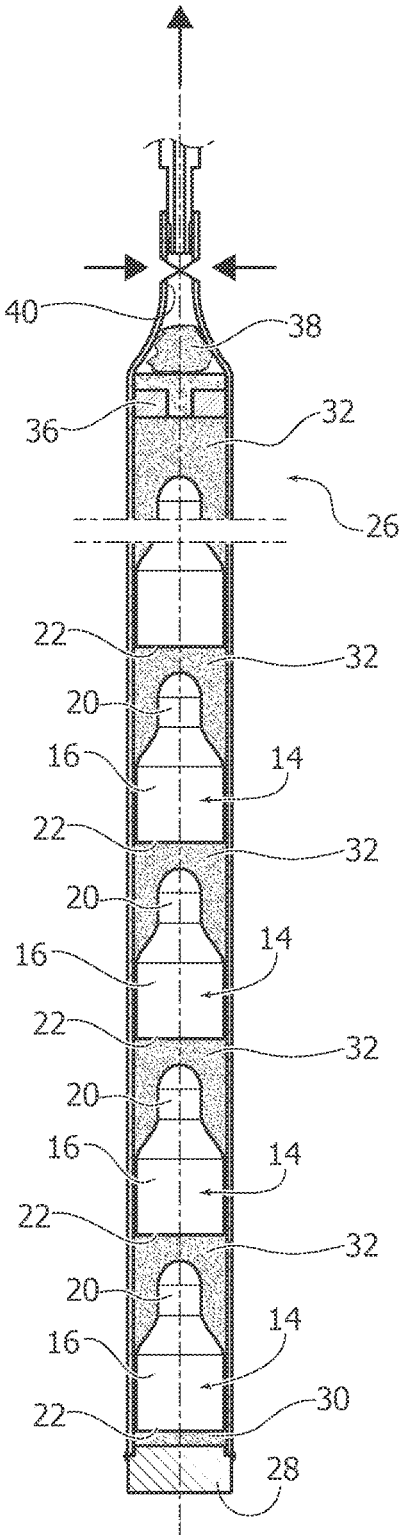
Figure 13:
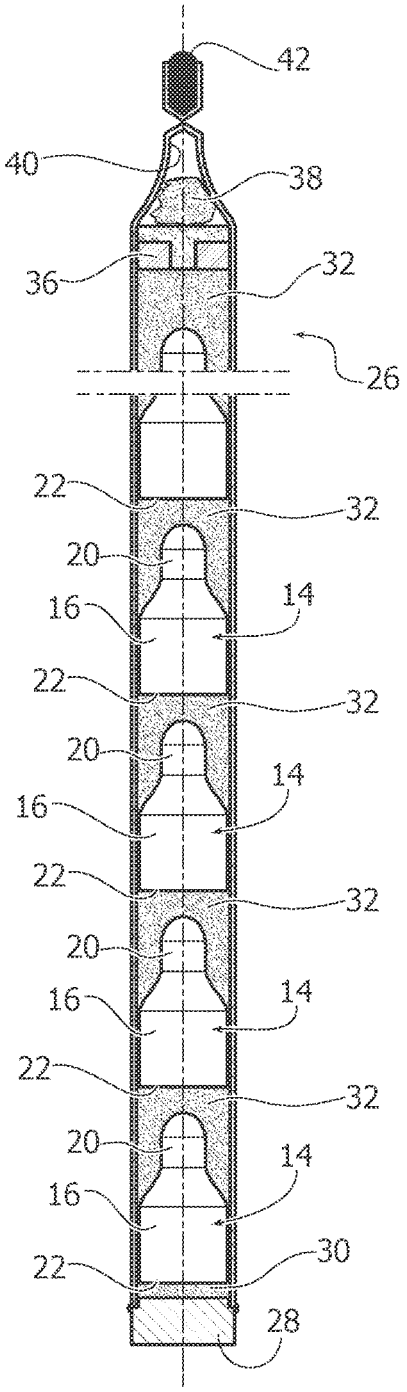

Then, a transverse pressing is carried out to close the channel 40, as shown in FIG. 12, and then a weld 42 is made, which seals the upper end of the containment tube 26.

The containment tube 26, prepared as described above, is subjected to hot isostatic pressing (HIP), during which the containment tube 26 is subjected to a temperature in the order of 1100-1200° C. and to an isostatic pressure in the order of 100 MPa, for a duration of 3-4 hours.

Figure 14:
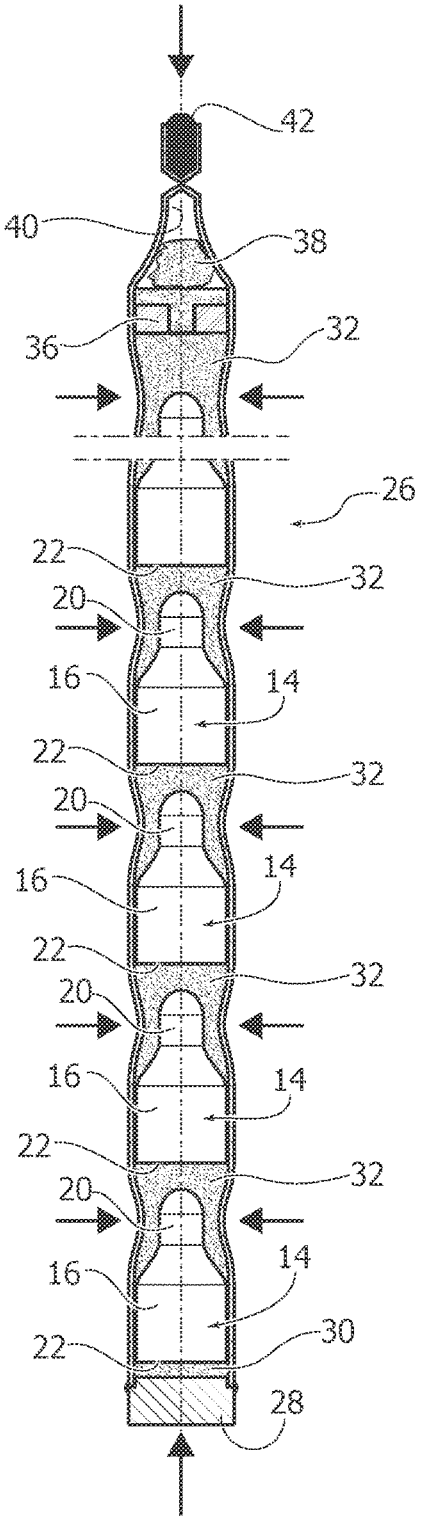

Following the method of hot isostatic pressing, the containment tube 26 is deformed, as shown in FIG. 14. The mass of powder 32 becomes solid by sintering and is bound to the outer surface of the respective nozzle tips 20. The protective discs 22 prevent the sintered powder becoming bound to the flat reference surfaces 18 of the nozzle blanks 14. The wall of the containment tube 26 is deformed at the areas corresponding to the nozzle tips 20 due to densifying of the powder. The method of hot isostatic pressing may be followed by an annealing step.

Figure 15:
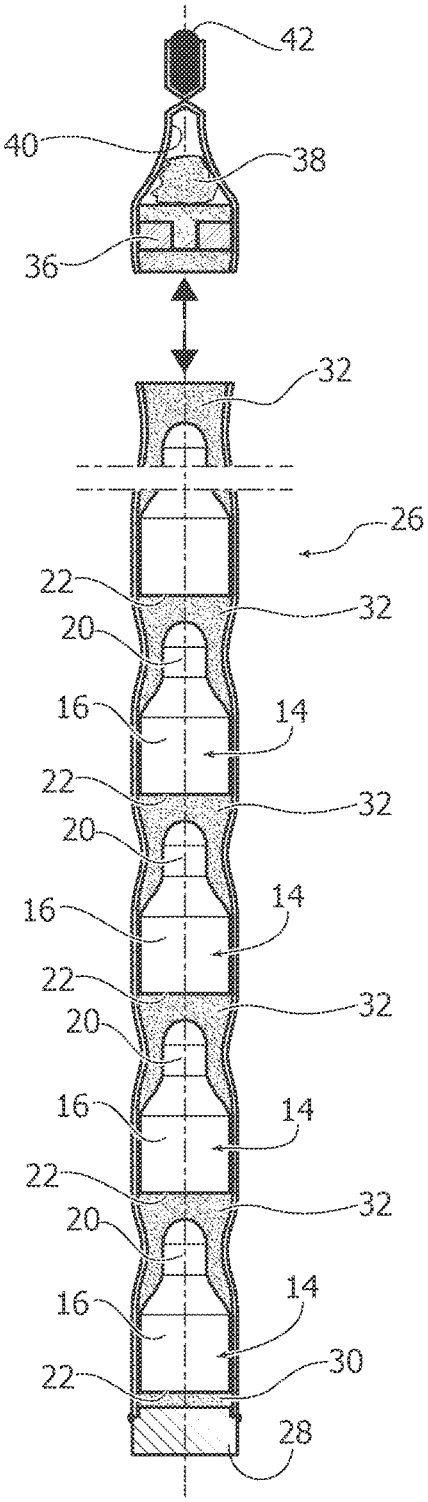
Figure 16:
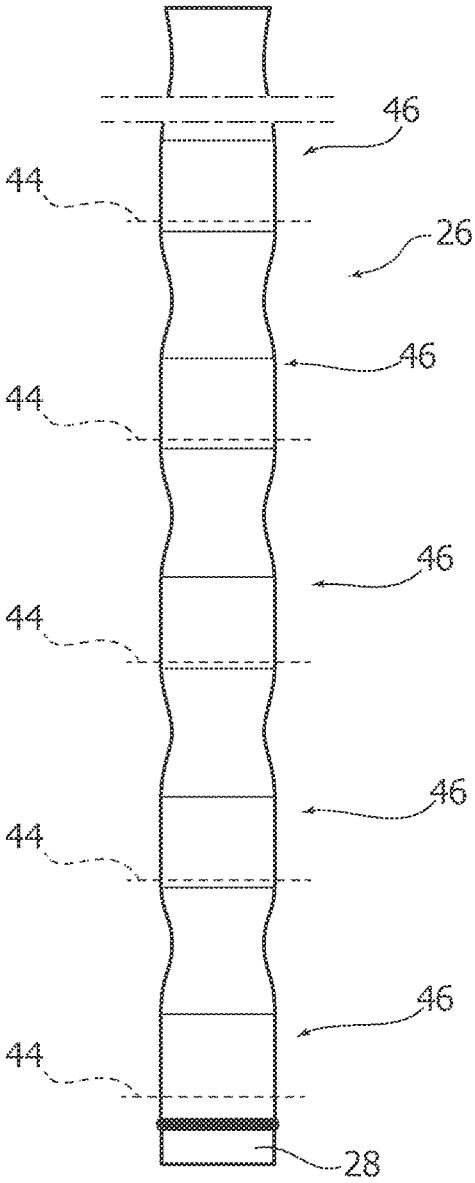

Subsequently, the upper part 42 of the containment tube 26 containing the perforated ring 36, the filter 38 and a part of solidified powder is cut and discarded as shown in FIG. 15. The remaining part of the containment tube 26 is cut in the transverse direction along a plurality of cutting sections 44, as shown in FIG. 16. The cut sections 44 are aligned with respective protective discs 22. During cutting along the cutting sections 44, the protective discs 22 are detached from the respective flat reference surfaces 18.

Figure 17:
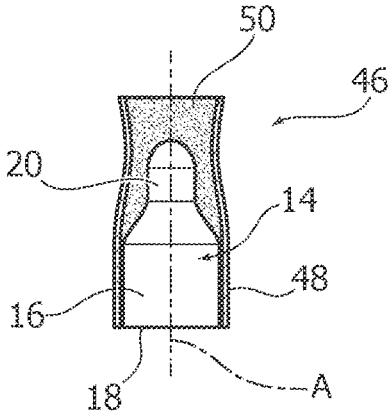

Following the transverse cut along the cutting sections 44, a plurality of sections 46 is obtained, each of which has the structure illustrated in FIG. 17. Each section 46 comprises an outer wall 48 formed of a respective portion of the containment tube 26. Within the outer wall 48, a nozzle blank 14 is contained, having a nozzle tip 20 coated with a body 50 formed by the powder 32 sintered during the process of hot isostatic pressing. The body 50 is bound to the nozzle tip 20 and to the inner surface of the outer wall 48. The nozzle blank 14 has a flat reference surface 18 devoid of sintered coating material since the flat reference surface 18 was covered by the protective disc 22 during the process of hot isostatic pressing, which prevented the contact of the flat reference surface 18 with the powder 32. In this way, the flat reference surface 18 of each section 46 is perfectly orthogonal to the longitudinal axis A of the respective nozzle tip 20.

Figure 18:
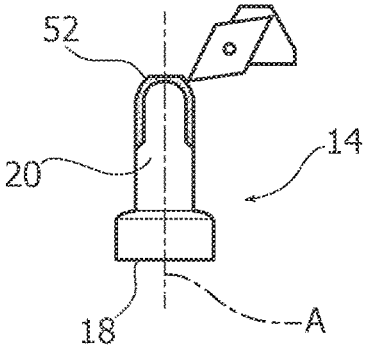

With reference to FIG. 18, each section 46 is subjected to machining, typically a turning operation, during the course of which, the outer wall 48, a part of the cylindrical surface 16 of the nozzle blank 14 and a part of the coating body 50 are removed. FIG. 18 schematically shows the nozzle blank 14 at the end of the machining. The nozzle blank 14 has a coating 52 of a material highly resistant to corrosion at the end of the nozzle tip 20, bound to the outer surface of the nozzle tip 20. The coating 52 is formed by the body part 50 that remains after the machining. The machining of the nozzle blank 14 is carried out taking as the reference surface for the machining the same flat reference surface 18 that was used as the reference surface for the preliminary machining of the nozzle blanks 14, carried out before the process of hot isostatic pressing. This ensures a perfect orthogonality of the flat reference surface 18 with respect to the longitudinal axis A of the nozzle blank 14. Thanks to this, during the machining, a perfect homogeneity of the thickness of the coating 52 around the nozzle tip 20 is obtained.

The method according to the present invention is advantageous with respect to solutions according to the prior art because it uses a simpler profile of the nozzle blank as there are no hollow portions, and it is produced by simpler and faster machining operations. The method according to the present invention does not require a precise coupling between the nozzle blanks and the inner surface of the containment tube. Moreover, thanks to the fact that during the entire process the nozzle blanks maintain the same reference surface that is used both for the preliminary turning and for the final turning, greater machining precisions are obtained and a better uniformity of the coating thickness.

Of course, without prejudice to the principle of the invention, the details of construction and the embodiments can be widely varied with respect to those described and illustrated, without thereby departing from the scope of the invention as defined by the claims that follow.

The invention claimed is:

1. A method for producing nozzles for injectors of internal combustion engines, comprising the steps of:

forming nozzle blanks by machining, each having a cylindrical surface, a flat reference surface at a first end of said cylindrical surface and a nozzle tip projecting from a second end of said cylindrical surface and having a longitudinal axis orthogonal to said flat reference surface;

applying a protective disc onto each flat reference surface;

providing a containment tube with a closed first end;

inserting, in sequence, said nozzle blanks into the containment tube, wherein after each insertion of a respective nozzle blank into said containment tube, a space delimited from an outer surface of the nozzle tip of the respective nozzle blank to an inner wall of the containment tube is filled entirely with metal powder;

compacting the metal powder and drawing air from a second end of the containment tube;

subjecting the containment tube to a step of hot isostatic pressing (HIP);

successively cutting said containment tube in a transverse direction along cutting sections aligned with said protective discs so as to form separate sections; and machining said sections so as to form a metallic coating on each nozzle tip.

2. A method according to claim 1, wherein said protective discs are of non-metallic material.

3. A method according to claim 2, wherein said protective discs are fixed to said flat reference surfaces by a layer of adhesive.

4. A method according to claim 2, wherein said protective discs are made of boron.

5. A method according to claim 1, wherein said cylindrical surfaces of said nozzle blanks are in contact with an inner cylindrical surface of said containment tube.

6. A method according to claim 1, wherein said metal powder forms separation layers between adjacent nozzle blanks.

7. A method according to claim 1, wherein said compacting step comprises compressing the powder with a presser and applying vibrations to said containment tube.

8. A method according to claim 1, comprising the provision of a filter for the powder in said second end of said containment tube.

9. A method according to claim 1, comprising the sealing of said second end of the containment tube after said air drawing.

* * * * *